United States Patent [19]

Müller

[11] Patent Number: 5,024,144

[45] Date of Patent: Jun. 18, 1991

[54] PISTON DRIVE

[76] Inventor: Fritz Müller, Neuer Wasen 6, 7118, Ingelfinger-Criesbach, Fed. Rep. of Germany

[21] Appl. No.: 395,486

[22] Filed: Aug. 18, 1989

[30] Foreign Application Priority Data

Aug. 31, 1988 [DE] Fed. Rep. of Germany ..... 3829566

[51] Int. Cl.[5] ..... F01B 31/14

[52] U.S. Cl. ..... 92/13.5; 92/13; 92/13.6; 92/128

[58] Field of Search ..... 92/13, 13.2, 13.4, 13.41, 92/13.5, 13.6, 128, 145; 251/285 X

[56] References Cited

U.S. PATENT DOCUMENTS

| | | | |
|---|---|---|---|
| 2,147,945 | 2/1939 | Hann et al. | 251/285 |
| 2,976,844 | 3/1961 | Goldring | 92/13.41 |
| 3,094,254 | 6/1963 | Cullen et al. | 92/13.2 |
| 3,160,077 | 12/1964 | Ribeiro et al. | 92/13.5 |
| 3,162,098 | 12/1964 | Lindberg | 92/13.5 |
| 3,175,473 | 3/1965 | Boteler et al. | 251/285 |
| 3,371,553 | 3/1968 | Miner | 92/13.5 |
| 3,410,518 | 11/1968 | Carsten | 251/285 |
| 3,830,139 | 8/1974 | Wachsman et al. | 92/13.5 |
| 3,978,884 | 9/1976 | Sundstrom | 251/285 |
| 4,671,485 | 6/1987 | Saarem | 92/13.2 |
| 4,883,412 | 11/1989 | Malizard et al. | 92/13.5 |

FOREIGN PATENT DOCUMENTS

| | | | |
|---|---|---|---|
| 309163 | 9/1971 | U.S.S.R. | 92/13 |
| 363167 | 12/1931 | United Kingdom | 92/13 |

*Primary Examiner*—John T. Kwon
*Assistant Examiner*—Thomas Denion
*Attorney, Agent, or Firm*—Henry M. Feiereisen

[57] ABSTRACT

A piston drive e.g. for actuating a valve includes a piston which reciprocates in axial direction within a housing between two end positions, with one end position being defined by a worm drive including a manually actuated worm which actuates a worm wheel movable in axial direction and defining a stop for the piston. The other end position is defined by a gear which is arranged in the path of movement of the piston and is provided with an internal gear meshing with the external thread of a stationary connecting piece of the housing. The gear is turned relative to the connecting piece and thus moved in axial direction by a tool which is insertable through a bore in the housing from the outside.

13 Claims, 1 Drawing Sheet

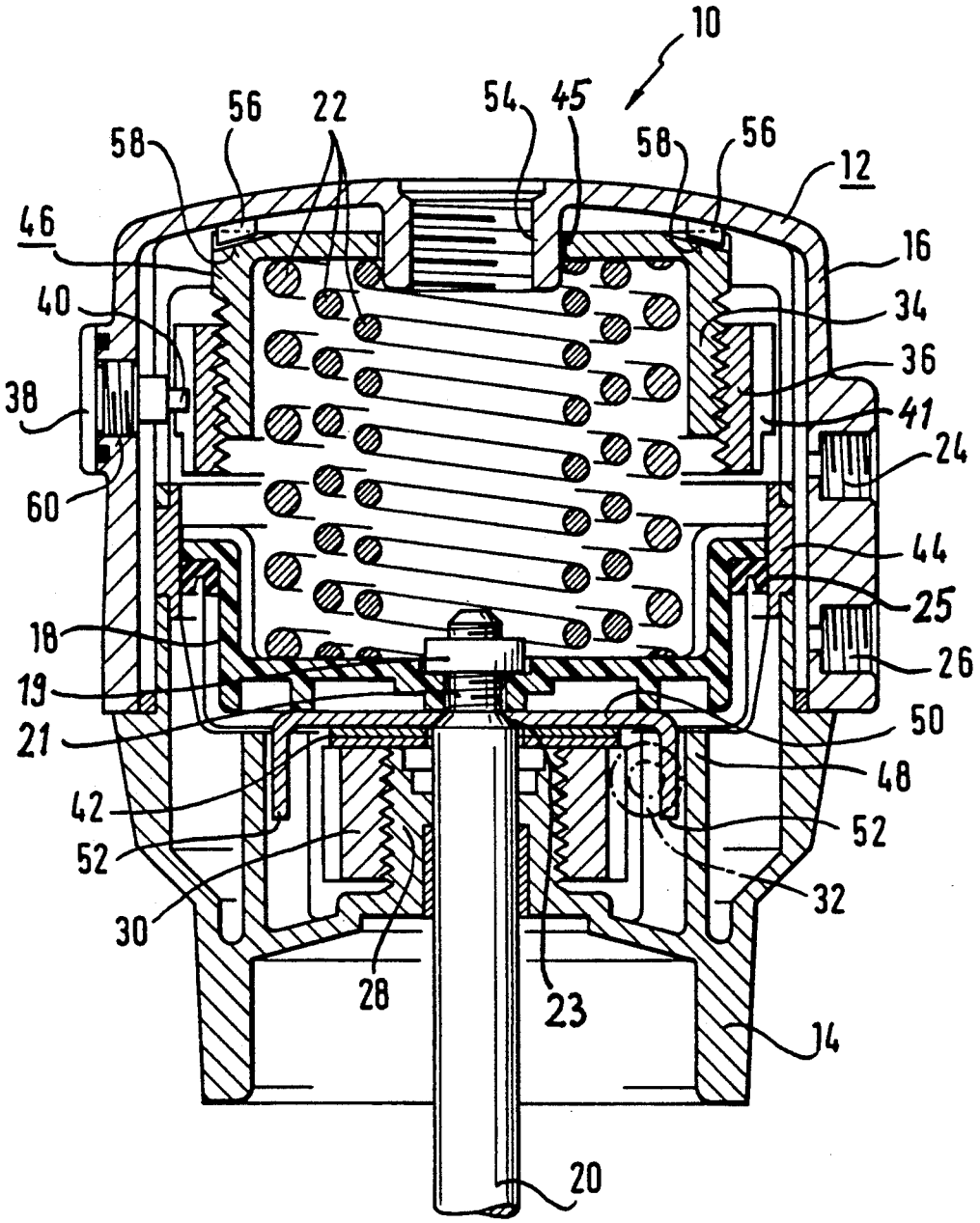
10
56
22
54
45
58
58
56
12
46
16
40
34
36
38
41
24
60
44
25
18
26
19
50
21
48
42
52
52
32
30
28
23
14
20

PISTON DRIVE

BACKGROUND OF THE INVENTION

The present invention refers to a piston drive, in particular to a piston drive for actuating a valve or the like.

In general, piston drives are known which include a housing accommodating a suitably sealed reciprocating piston linked to a piston rod acting upon an operating device such as a valve in dependence on the stroke of the piston.

SUMMARY OF THE INVENTION

It is an object of the present invention to provide an improved piston drive which is of simple constructive design and yet reliable in operation.

This object and others which will become apparent hereinafter are attained in accordance with the present invention by providing a worm wheel which acts upon the piston and is provided with an internal thread in mesh with the external thread of a nipple of the housing so as to be movable in axial direction in order to define one of the end positions between which the piston reciprocates.

According to a further feature of the present invention, the other end position may be defined by a gear which projects into the path of movement of the piston and is axially movable along the external thread of a stationary connecting piece which is mounted to the housing. In the area of the gear, the housing is suitably provided with a threaded opening through which a tool may be inserted to reach into the tooth space between two adjoining teeth of the gear for turning the gear and thus for attaining its axial displacement.

Preferably, the threaded opening is closable by a plug provided with a radial projection which protrudes into the tooth space between two adjoining teeth to lock the gear.

BRIEF DESCRIPTION OF THE DRAWING

The above and other objects, features and advantages of the present invention will now be described in more detail with reference to the accompanying drawing in which:

The sole FIGURE shows schematically a longitudinal section of one embodiment of a piston drive in accordance with the present invention.

DETAILED DESCRIPTION OF A PREFERRED EMBODIMENT

Referring now to the sole FIGURE of the drawing, there is shown a longitudinal sectional view of a piston drive generally designated by reference numeral 10. The piston drive 10 includes a housing 2 with a lower housing part or base 14 and an upper housing part or lid 16. The housing parts 14, 16 are suitably connected to each other for example through threaded engagement via respective screws (not shown). Accommodated in the housing 12 is a piston 18 which reciprocates in axial direction between two end positions and is guided in a piston bushing 44.

Centrally mounted to the piston 18 via a nut 19 is the threaded end 21 of a piston rod 20 which extends beyond the axial end of the housing 12 for allowing attachment of a suitable device such as e.g. a diaphragm of a diaphragm valve which is actuated by the piston 18 for example for opening and closing the valve. The threaded end 19 of the piston rod 20 is of reduced diameter and connected to the main portion of the rod 20 via a conical part 23, the purpose of which will be described hereinafter.

The piston as illustrated in the exemplified embodiment as shown in the FIGURE is designed as a multipart element and includes the actual piston 18 which is made of plastic material and suitably sealed by a seal 25 and a reinforcing element 50 for the piston 18. The reinforcing element 50, which is made of metal such as e.g. sheet steel, extends at the underside of the piston 18 and rests on the conical portion 23 of the piston rod 20. It will be appreciated, however, that instead of the illustrated multipart piston, it is certainly feasible to design the piston as a one-part element.

Acting upon the top side of the piston 18 are a plurality of compression springs 22 which urge the piston 18 in downward direction for closing the not shown valve At a suitable lateral location, the housing 12 is provided with an inlet port 26 and an outlet port 24 for circulation of a pressure fluid such as compressed air. The pressure fluid is supplied to the inlet port 26 and introduced into the housing 12 at an area below the piston 18 to thereby allow the piston 18 to be axially shifted upwardly against the force exerted by the compression springs 22 and to open the valve which is linked to the piston rod 20.

In order to adjust the lower end position of the piston 18, the lower housing part 14 of the housing 12 is provided with a nipple 28 which axially projects upwardly concentric to the center axis of the housing 12 and includes an external thread meshing with the internal thread of a worm wheel 30. As shown in the FIGURE, the nipple 28 serves also as guide for the piston rod 20.

The worm wheel 30 forms a part of a worm drive which further includes a worm 32 which is only schematically indicated by dash-dot line. It should be noted that the illustration of the FIGURE shows the worm 32 turned by 90°. In reality, the worm 32 lies behind the sectional plane of the FIGURE and extends beyond the housing 12 so as to allow manual actuation thereof from the outside.

Thus, by suitably actuating the worm 32, the worm wheel 30 turns and is shifted in axial direction along the stationary nipple 28 to thereby allow adjustment of the lower end position of the piston 18.

Suitably, one or more disks 42 may be loosely sandwiched between the piston 18 i.e. its reinforcing element 50 and the worm wheel 30 in order to evenly transmit the forces between the worm wheel 30 and the piston 18. In the embodiment as shown in the FIGURE, two such disks 42 are provided.

In order to define a lowermost end position of the piston 18, the lower housing part 14 is further provided with an upwardly projecting flange 48 which extends in the path of movement of the piston 18 to provide a stationary and unchangeable stop member.

As is further shown in the FIGURE, the reinforcing element 50 is provided with two axially downwardly bent projections 52 which engage complementary grooves or recesses (not shown) in the housing 12 to prevent a rotation of the reinforcing element 50 and the linked piston 18. It will be appreciated that the reinforcing element 50 may also be provided with only one such projection 52 or with more than two such projections 52.

The lower end position of the piston 18 is thus easily adjustable by means of the worm drive by suitably operating the worm 32 and the worm wheel 30. If desired, the lower end position of the piston 18 can be selected in such a manner that the valve to be operated by the piston drive 10 is still slightly opened even when the piston 18 occupies its lower end position in order to ensure a minimum passage through the valve. Further, the worm drive allows also an actuation in emergency situations such as failure of the electric control mechanism or of the supply of compressed air. In these situations, the piston 18 can still be raised or lowered manually in axial direction so as to open or close the valve which is linked to the piston 18 via the piston rod 20.

For adjusting the other, upper end position of the piston 18 and thus for adjusting the stroke thereof, the upper housing part 16 of the housing 12 is provided with a central, inwardly directed socket 54 which extends through a bore 45 of an insert 46 of inverted cup-shape. The insert 46 which is thus retained in centered position by the socket 54 includes a cylindrical connecting piece 34 which is provided with an external thread meshing with the internal thread of a gear 36. The compression springs 22 which act upon the piston 18 with their one end to urge the piston 18 in downward direction bear with their other end against the insert 46 to urge the latter against the inner end face of the upper housing part 16.

The insert 46 is stationarily placed within the upper housing part 16 of the housing 12 via the socket 54 and secured against rotation by suitable means such as lugs 56 which project from the upper housing part 16 and engage in complementary grooves 58 of the insert 46. As shown in the FIGURE, the gear 36 faces the piston 18 and thus extends in the path of movement of the piston 18 so as to provide a stop member for the movement of the piston 18 in upward direction. By respectively turning the gear 36 relative to the connecting piece 34, the gear 36 is movable upwardly or downwardly in axial direction to adjust the upper end position of the piston 18 i.e. the stroke of the piston 18.

The adjustment of the gear 36 in axial direction is attained by a suitable tool e.g. a screwdriver (not shown) which is insertable into the tooth space between two adjoining teeth 41 of the gear 36 through a bore such as threaded opening 60. Suitably, the opening 60 is arranged on the side of the upper housing part 16 in vicinity of the gear 36 i.e. opposite to the teeth of the gear 36. Thus, by inserting the tool into the respective tooth space and by suitably pivoting or tilting the tool, the gear 36 can be turned step-by-step. After readjusting the gear 36, the threaded opening 60 is closed by a suitably sealed plug 38 which at its forward inner end facing the insert 46 is provided with a radial projection 40 engaging the tooth space between two adjoining teeth 41 in order to lock the gear 36 when the plug 38 is threadably engaged within the opening 60.

Thus, the adjustment of the stroke of the piston 18 is attained in a very simple manner by turning the gear 36. In the exemplified embodiment of the present invention as shown in the FIGURE, the insert 46 is a separate element. However, it will be readily recognized that the connecting piece 34 may also be directly attached to the upper housing part 16 so as to form a one-piece element.

While the invention has been illustrated and described as embodied in a piston drive, it is not intended to be limited to the details shown since various modifications and structural changes may be made without departing in any way from the spirit of the present invention.

What is claimed as new and desired to be protected by LETTERS PATENT is set forth in the appended claims:

I claim:

1. A piston drive for actuating an element such as a valve, comprising:

a housing defining an axis and including a connecting piece provided with an external thread;

piston means operatively connected to the element and including a piston reciprocating in axial direction within said housing between two end positions;

first adjusting means for defining one of said end positions of said piston, said first adjusting means including a worm drive having a worm wheel acting upon said piston and provided with an internal thread in mesh with said external thread of said connecting piece so as to be movable in axial direction; and second adjusting means accommodated in said housing for defining the other one of said end positions, said second adjusting means including a further connecting piece mounted to said housing and a gear extending in the path of movement of said piston and cooperating with said further connecting piece so as to be movable in axial direction, said gear being accessible from outside through an opening of said housing to permit adjustment thereof.

2. A piston drive as defined in claim 1 wherein said worm drive further includes a worm cooperating with said worm wheel and being actuatable from the outside for allowing adjustment of said worm wheel in axial direction.

3. A piston drive as defined in claim 1 wherein said further connecting piece includes an external thread, said gear including an internal thread in mesh with said external thread of said further connecting piece.

4. A piston drive as defined in claim 1 wherein said opening is constituted by a lateral bore provided in said housing in the area of said gear for allowing insertion of a tool between two adjacent teeth of said gear and to permit adjustment of said gear from the outside by turning said gear relative to said further connecting piece.

5. A piston drive as defined in claim 4, and further comprising a plug for closing said bore, said plug including a radial projection engaging in a tooth space between two adjoining teeth of said gear for locking said gear.

6. A piston drive as defined in claim 1 wherein said piston means further includes a reinforcing element arranged between said piston and said worm wheel.

7. A piston drive as defined in claim 6 wherein said reinforcing element is provided with at least one downwardly extending projection engaging a groove in said housing for preventing a rotation of said reinforcing element and said piston.

8. A piston drive as defined in claim 6 wherein said reinforcing element is of metal.

9. A piston drive as defined in claim 8 wherein said reinforcing element is made of sheet steel.

10. A piston drive as defined in claim 6, and further comprising at least one disk sandwiched between said reinforcing element and said worm wheel for allowing even transmission of forces exerted from said worm wheel to said piston.

11. A piston drive as defined in claim 1 wherein said piston means further includes a piston rod attached to said piston and linked to the element for transmitting the movement of said piston to thereby actuate the element.

12. A piston drive for actuating an element such as a valve, comprising:

a housing defining an axis and including a connecting piece provided with an external thread;

piston means including a piston reciprocating in axial direction within said housing between two end positions;

first adjusting means for defining one of said end positions of said piston, said first adjusting means including a worm drive having a worm wheel acting upon said piston and provided with an internal thread in mesh with said external thread of said connecting piece so as to be movable in axial direction, said piston means further including a reinforcing element arranged between said piston and said worm wheel; and at least one disk sandwiched between said reinforcing element and said worm wheel for allowing even transmission of forces exerted from said worm wheel to said piston.

13. A piston drive for actuating an element such as a valve, comprising:

a housing defining an axis;

piston means operatively connected to the element and including a piston reciprocating in axial direction within said housing between two end positions;

first adjusting means for defining one of said end positions of said piston, said first adjusting means including a worm drive with a worm wheel acting upon said piston and being movable in axial direction, said worm wheel and said gear being actuable from outside through respective openings of said housing for movement in axial direction to thereby control said end positions of said piston.

* * * * *

UNITED STATES PATENT AND TRADEMARK OFFICE

CERTIFICATE OF CORRECTION

PATENT NO. : 5,024,144

DATED : June 18, 1991

INVENTOR(S) : FRITZ MULLER

It is certified that error appears in the above-identified patent and that said Letters Patent is hereby corrected as shown below:

Claim 13, column 6, line 18, after "tion" add -- ; and second adjusting means for defining the other one of said end positions, said second adjusting means including a gear extending in the path of movement of said piston and being movable in axial direction --.

Signed and Sealed this

Thirteenth Day of October, 1992

*Attest:*

DOUGLAS B. COMER

*Attesting Officer*

*Acting Commissioner of Patents and Trademarks*